United States Patent [19]

Sapkus

[11] 4,369,690

[45] Jan. 25, 1983

[54] HAIR BRAIDING APPARATUS

[75] Inventor: Jurgis Sapkus, Manhattan Beach, Calif.

[73] Assignee: Mattel, Inc., Hawthorne, Calif.

[21] Appl. No.: 303,336

[22] Filed: Sep. 18, 1981

[51] Int. Cl.[3] ..... A45D 2/00; A45D 6/00; A45D 1/00; D04C 7/00

[52] U.S. Cl. ..... 87/33; 87/8; 87/13; 87/62; 132/9

[58] Field of Search ..... 87/33, 62, 30, 8, 13; 57/4, 28–30; 132/5, 7, 9, 33 C, 34 R, 38 A, 56

[56] References Cited

U.S. PATENT DOCUMENTS

| | | | |
|---|---|---|---|
| 1,067,103 | 7/1913 | Fisher | 132/56 |
| 1,508,014 | 9/1924 | Dittrich | 132/56 |
| 1,795,385 | 3/1931 | Yokoyama | 87/62 |
| 3,053,133 | 9/1962 | Payson, Jr. | 87/33 |
| 3,421,406 | 1/1969 | Mitchell et al. | 87/30 |
| 4,038,996 | 8/1977 | Eronini et al. | 132/9 |

*Primary Examiner*—John Petrakes

*Attorney, Agent, or Firm*—John G. Mesaros; Ronald M. Goldman; Max E. Shirk

[57] ABSTRACT

A hand held, hand operated hair braiding apparatus having a plurality of aligned gear members, each having an aperture therethrough for passage therethrough of a strand of hair, with a first pair of adjacent gear members having the positions interchanged in response to actuation of a lever member in a first direction with the remaining gear member then being interchanged with the adjacent one in response to pivoting of the lever member in the reverse direction. There is also disclosed an accessory device for facilitating the use of the hair braiding apparatus.

11 Claims, 12 Drawing Figures

HAIR BRAIDING APPARATUS

BACKGROUND OF THE INVENTION

The background of the invention will be discussed in two parts.

1. Field of the Invention

This invention relates to hair braiding apparatus and more particularly to hand operated hair braiding apparatus.

2. Description of the Prior Art

Braiding machines have been used extensively in the textile industry. Such braiding machines are shown and described, for example, in U.S. Pat. Nos. 830,137 issued Sept. 4, 1906 to Diss; 1,398,444 issued Nov. 29, 1921 to Pfrunder; Re. 15,909 issued Sept. 2, 1924 to Pfrunder; and 3,421,406 issued Jan. 14, 1969 to Mitchell, et al. Such braiding machines have heretofore been complicated apparatus intended to be part of an overall machine, and ordinarily employ complex mechanisms.

A braiding machine intended specifically for braiding hair is shown and described in U.S. Pat. No. 4,038,996 issued Aug. 2, 1977 to Eronini, et al. The hair braider apparatus of this patent is a portable hair braider which is motor operated and uses a plurality of foot members for hair parters to divide the hair over a predetermined width of the scalp with hair grippers or grabbers then clamping the parted hair and rotating the strands for weaving them together to form a braid.

It is an object of the present invention to provide a new and improved hair braiding apparatus.

It is another object of the present invention to provide a new and improved hand operated hair braiding apparatus.

It is still another object of the present invention to provide a new and improved economical hair braiding apparatus for use with human hair or the simulated hair of a doll or the like.

SUMMARY OF THE INVENTION

The foregoing and other objects of the invention are accomplished by providing a hair braiding apparatus having a housing with a pair of intersecting generally cylindrical recesses forming a figure eight for receiving therein first and second sector gears having concave edge portions for receiving elliptical gear segments therebetween, there being three elliptical gear segments. The housing has pivotally supported therein a trigger member having an arcuate rack portion operating against a pinion gear having the axle thereof in a slotted opening. Upon depression of the trigger member in a first direction, the pinion gear coacts with a first sector gear member to interchange the position of the first two of the elliptical gear members; and in a reverse direction of movement of the trigger member, the rack portion urges the pinion into coaction with the second gear member to interchange the position of the two elliptical gear members associated therewith. Each of the elliptical gear members is provided with means for passing a strand of hair therethrough. An accessory device is also illustrated for facilitating the use of the hair braiding apparatus.

Other objects, features and advantages of the invention will become apparent from a reading of the specification, when taken in conjunction with the drawings, in which like reference numerals refer to the like elements in several views.

DESCRIPTION OF THE PREFERRED EMBODIMENT

Figure 1:
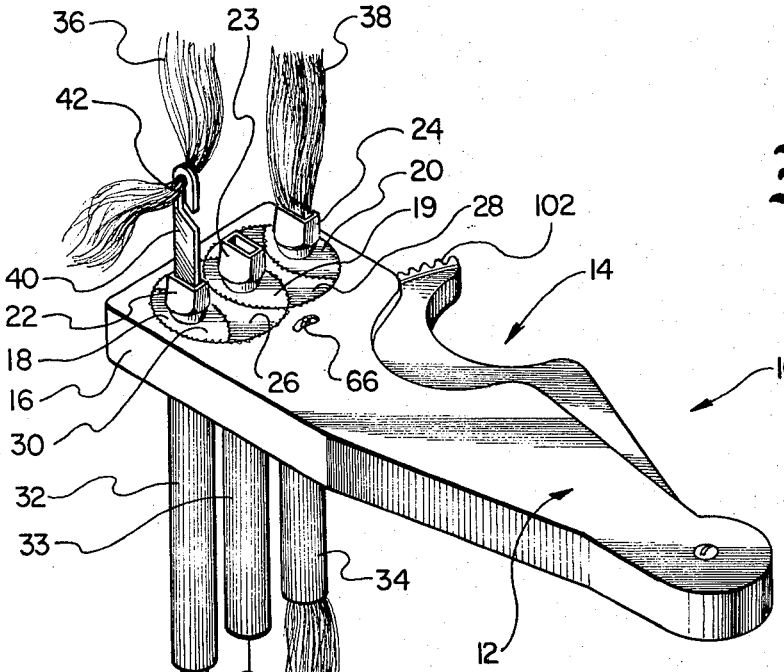
FIG. 1 is a perspective view of the braiding apparatus according to the invention with strands of hair inserted therein.
Figure 2:
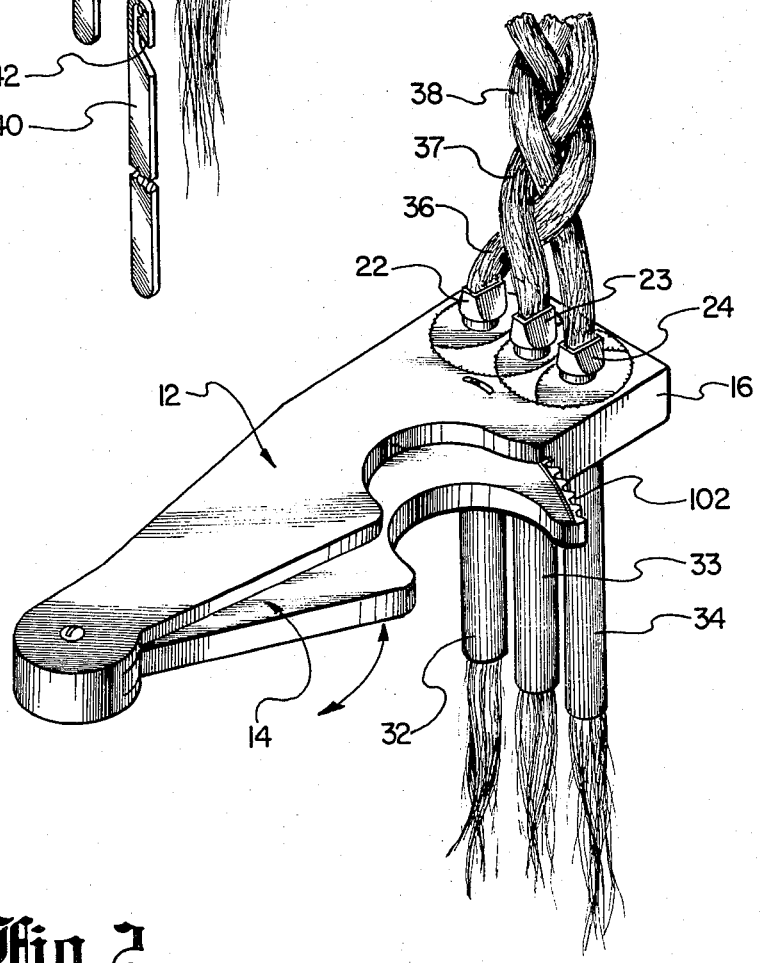
FIG. 2 is another perspective view of the braiding apparatus according to the invention from a different angle to depict the trigger mechanism and the braiding operation.

Referring now to the drawings, and particularly to FIGS. 1 and 2, there are shown perspective views of the braiding device generally designated 10, which includes a main housing 12 with a trigger member 14 pivotally supported therein. The housing 12 and trigger member 14 are configured for gripping by the hand of the user.

At one end 16 of the housing 12 there is mounted within the housing 12 three elliptical gear members 18–20 with tension tips 22–24 extending upwardly therefrom with the elliptical gear members 18–20 having interposed therebetween identical hourglass shaped sector gear members 26 and 28. The upper surface of the housing 12 is provided with an opening 30 configured in the form of a figure eight, which is essentially two overlapping circular openings. Carried by the elliptical gear members 18–20, in depending relation therewith are three tubular members 32–34 respectively.

As will hereinafter be described, the tension tips 22–24 along with their respective elliptical gear members 18–20 along with the tubular members 32–34 have an aperture extending therethrough for passage therethrough of strands of hair 36–38 inclusive. For this purpose, by reference to FIG. 1, one or more feeding blades 40 are provided with hook-shaped ends 42 and with the blade 40 inserted through one of the apertures defined by, for example, tube 32, elliptical gear member 18 and tension tip 22, the strand of hair 36 is engaged within hook 42 of blade 40 and drawn through the opening. Correspondingly, second and third strands of hair 37 and 38 will be drawn through the next two openings of the braiding apparatus 10. The feeder blades 40 will then be removed and the apparatus is ready for use.

By reference to FIG. 2, briefly, after the strands 36–38 are inserted through the respective openings, alternate pivoting of trigger member 14 in a direction indicated by the double ended arrow adjacent thereto, will result in alternately repositioning of a first pair of elliptical gear members through an angle of 180° when the trigger member 14 is pivoted inwardly, and then repositioning one of the so repositioned elliptical gears in conjunction with the remaining gear in the reverse direction through an angle of 180° resulting in the braiding of the strands of hair 36–38 as depicted in FIG. 2. This action will be discussed in more detail later.

Figure 3:
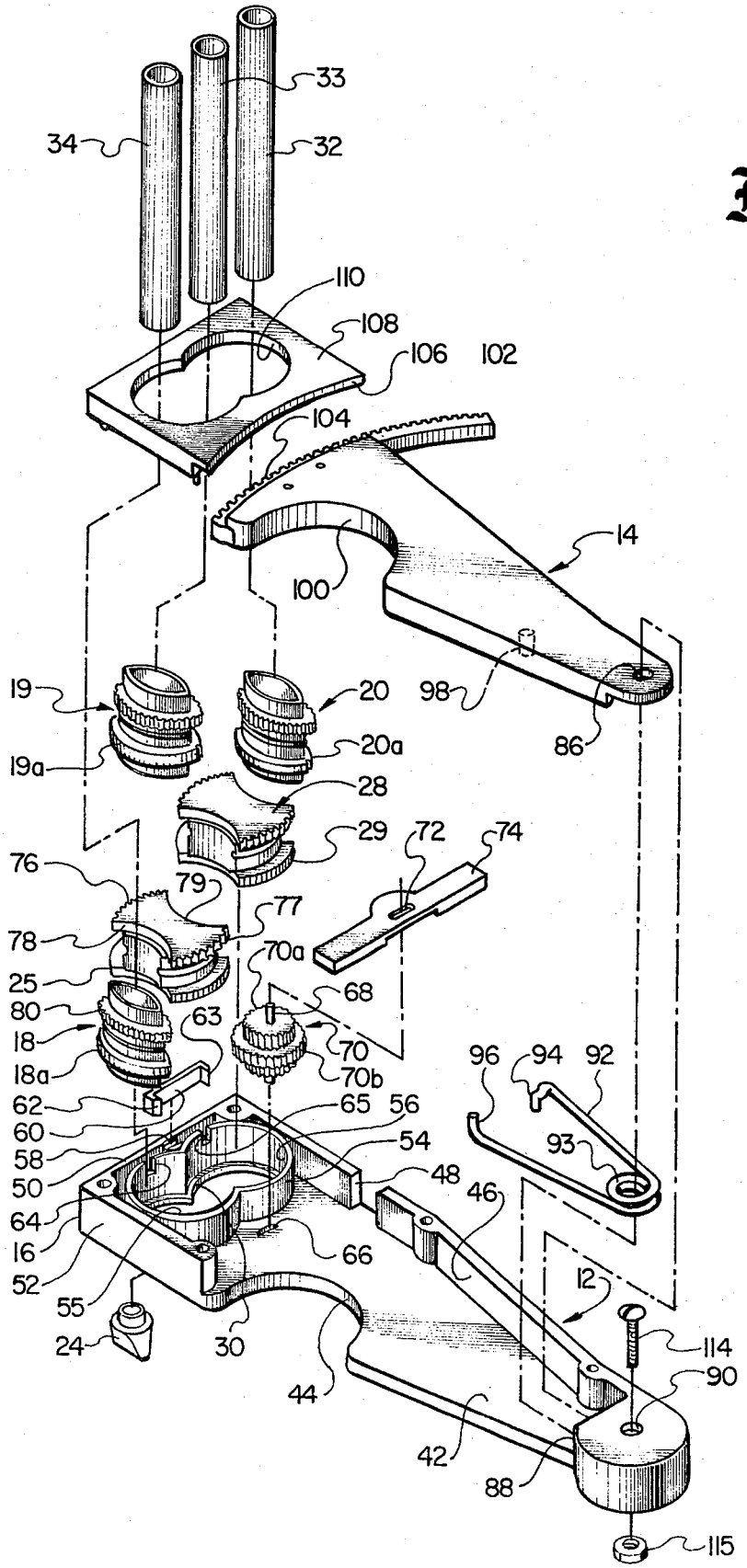
FIG. 3 is an inverted exploded perspective view of the braiding apparatus of FIG. 1.

Referring now to FIG. 3, the braiding device 10 is illustrated in inverted exploded perspective view. The housing 12 shown in inverted position, is a hollowed out structure including a planar portion 42 with an arcuately curved recess 44 configured for permitting actuation of the trigger member 14. One long edge of the planar portion 42 is provided with a generally perpendicular wall portion 46 which extends the length of one side of the housing 12 with the exception of a slot 48. Second and third walls 50 and 52 of the same height, along with a portion of wall 46 enclose the end 16 of the housing 12. Formed within this enclosure is a shell 54 having a "figure eight" configuration for receiving therein the active moving components of the braiding device 10. Essentially the shell 54 is configured as two overlapping circular portions defining circular recesses 55 and 56 respectively.

At the juncture of the recesses 55 and 56, and externally thereof, there is formed within the housing 12 a retainer pin 58 having a slot therein for receiving a detent member 60 which has pawls 62 and 63 configured for extending through slots 64 and 65 respectively formed in the walls of recesses 55 and 56 respectively.

An arcuate slot 66 passes through the planar portion 42 of the housing 12 in proximity to, but externally of, the approximate midpoint of the shell 54. One end of an axle 68 of a pinion gear 70 is received within this slot 66 while the other end of axle 68 passes through a similarly configured elongated slot 72 formed at the approximate midpoint of an axle-supporting bar 74 which is suitably secured within housing 12.

As previously described, the main operative components of the braiding device 10 include three identically configured elliptical gear members 18–20 positioned in aligned space relation with intervening sector gear members 26 and 28, all being configured for being received within the circular recesses 55 and 56. Each of the sector gear members 26 and 28 is identically configured and provided with an hourglass configuration with the convex portions 76 and 77 of sector gear member 26, for example, having gear teeth thereon, with the concave edges 78 and 79 being smooth. The gear teeth edges 76 and 77 are part of a circle of a given diameter with the smooth edges 78 and 79 being arcs of a circle of the same diameter and of the same diameter as the adjacent gear teeth edge 80 of the elliptical gear 18 for example. By brief reference to FIG. 4, it can be seen, that with one sector gear member 26 arranged and positioned with the adjacent elliptical gear members 18 and 19, a circle is defined with the circle having a given diameter. Similarly, viewing sector gear 28 with elliptical gear members 19 and 20, a second circle of the same diameter is defined with opposite gear edges of the elliptical gear member 19 forming parts or arcs of both circles.

Referring again to FIG. 3, the trigger member 14 is essentially wedge-shaped with the narrow end having an aperture or pivot axis 86 formed therein for being received within a recess 88 at the narrow end of housing member 12, with the aperture 86 being in alignment with a pair of similar apertures 90 on opposite sides of the cavity or recess 88. A suitable compression spring member 92 is also received within the cavity or recess 88 with the coil portion 93 of spring member 92 being in alignment with the aperture 90. One free end 94 of spring member 92 is configued for abutting engagement with the interior of wall 46 while the other end 96 of spring member 92 has an upwardly extending projection for being received within an aperture 98 formed in the facing surface of trigger member 14. One edge of trigger member 14 is provided with an arcuate cutout 100 configured similarly to the recess 44 of housing member 12 in alignment therewith. The wide edge of trigger member 14 has affixed thereto an arcuate rack member 102 with the adjacent edge 104 of trigger member 14 being recessed from the teeth thereof for providing a shoulder portion. The shoulder portion 104 rides against a similarly contoured edge 106 of a bottom cover plate 108 which is secured to the walls 46, 50 and 52 after assembly. The bottom cover plate 108 is provided with an opening 110 identically configured, and in alignment with, the "figure eight" opening 30 formed in the planar portion 42 of the housing 12. Also depicted in FIG. 3 are the tubular members 32–34 and one of the tension tips 24.

For assembly of the braiding device 10, by reference to FIG. 3, the sector gear members 26 and 28 are placed within the recesses 55 and 56 in aligned relation with the lower flange portions 25 and 29 of sector gear members 26 and 28 respectively resting on the shoulders of the opening 30 and acting as bearing surfaces within the shell 54. The elliptical gear members 18, 19 and 20 are then placed in the respective locations within the recesses 55 and 56 (see also FIG. 4) with the lower flange portions **18*a*–20*a* also acting as bearing surfaces. The detent member 60 is then positioned within the slot of retaining post 58 with the pawls 62 and 63 extending through the slots 64 and 65, respectively, for engaging one of the aligned pair of apertures 26*a* and 28*a* within the grooves 26*b* and 28*b* of the respective sector gears 26 and 28. Next in order, one end of axle 68 of pinion gear 70 is positioned within the arcuate slot 66 and the axle retaining member 74 is positioned thereover with the other end of axle 68 through the elongate slot 72 with opposing ends of axle member 74 then being suitably secured to the opposing walls 46 and 52**.

Next in order, the coil end 93 of spring member 92 is inserted within the cavity or recess 88 and the trigger member 14 is positioned thereon with the end 96 engaging the aperture 98 on the facing surface of trigger member 14. The aperture 86 in the narrow end of trigger member 14 is received within the cavity or recess 88 and a suitable fastening means such as screw 114 is passed through aperture 90, through aperture 86, and through the coiled end 93 and then secured by a suitable nut 115 for retaining the trigger member 14 within the housing 12. At this point, the gear teeth of the arcuate rack 102 are engaging the small diameter gear portion **70*a* of the pinion gear member 70 (see also FIG. 4). In this position, the top surface (bottom surface in the inverted view of FIG. 3) of rack 102 is slightly engaging the planar portion 42 of the housing 12 with the slot 48 within wall 46 being provided for passage therethrough of the extending portion of rack 102 of trigger member 14. The bottom cover plate 108 is then positioned over the end 16 of the housing 12 and suitably secured to the facing edges of the walls 46, 50 and 52 with the contoured edge 106 of bottom cover plate 108 in slighting engagement with the shoulder 104 of trigger member 14. The tension tips 24 and tubes 32–34** are then suitably fastened to complete assembly.

Figure 4:
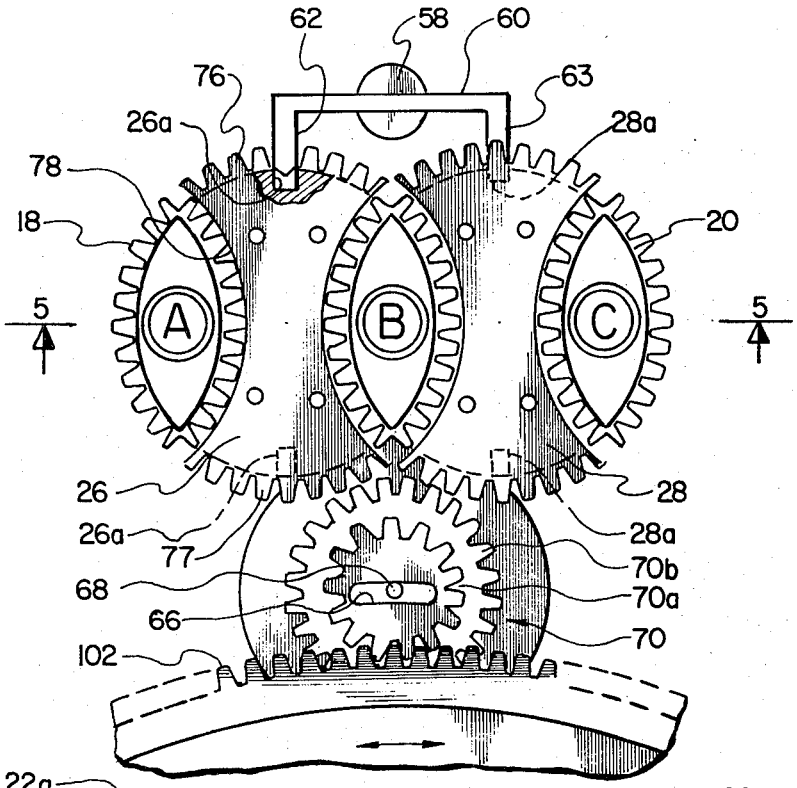
FIG. 4 is an enlarged diagrammatic plan view of the braiding gear components of the apparatus of FIG. 1.

By reference to FIG. 4, the operative components are shown in assembled relation in diagrammatic illustration with the openings of the elliptical gear members 18–20 through which the hair strands 36–38 pass being identified by reference letters A, B and C. The pinion gear 70 is shown in its neutral position, that is, with the axle 68 thereof midway within the elongate slot 66. In this position, the small diameter gear portion 70*a* has the teeth thereof in engagement with the arcuate rack 102 while the large diameter gear portion 70*b* of pinion gear 70 is in proximity to but out of engagement with the gear teeth of either of the sector gear members 26 and 28. As will be described hereinafter, the large diameter gear portion 70*b* alternately engages gear edges for rotation through 180°, with a first gear edge being defined by the gear teeth 76 and 77 of sector gear 26 plus the outer gear surfaces of elliptical gears 18 and 19, this outer gear edge effectively defining a circular gear edge. The alternate gear edge would include the opposite edge of gear teeth on the elliptical gear 19 plus the opposing gear edges of sector gear 28 plug the outer gear teeth of elliptical gear 20.

Figure 5:
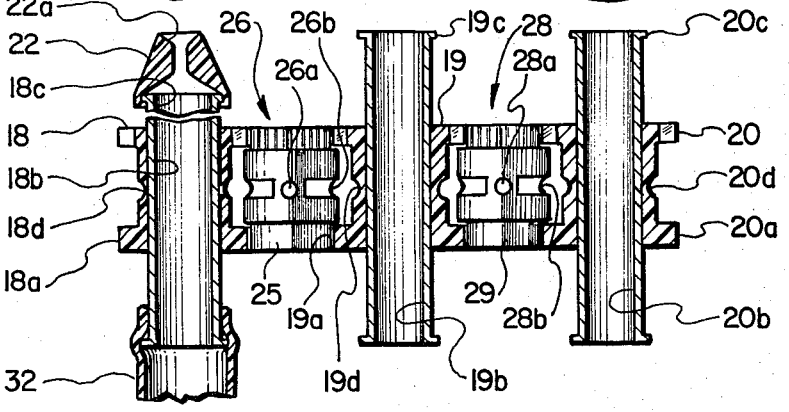
FIG. 5 is a cross-sectional view of the braiding gear components shown in FIG. 4 as viewed generally along Line 5—5 thereof.

FIG. 5 illustrates the operative components depicted in FIG. 4 in cross-section with the tension tip 22 and tubular sleeve 32 coupled to the elliptical gear member 18, it being understood that there would be similar tension tips and tubular sleeves on each of the other elliptical gear members 19 and 20. The tension tip 22 is formed of rubber or other suitable resilient material and includes a funnel-shaped opening 22*a* extending therethrough, the tension tip 22 frictionally engaging an upwardly extending projection 18*c* of the elliptical gear member 18. A strand of hair is passed through the opening 22*a* of tension tip 22 and thence through the opening 18*b* of the elliptical gear member 18 and thence through the tubular sleeve 32 by means of the feeder blade 40 previously described in conjunction with FIGS. 1 and 2. Since the opening 22*a* is narrower, it serves as a frictional engagement of a strand 36 passed therethrough while the depending tube 32 keeps the unbraided strands apart to prevent matting.

Figure 6:
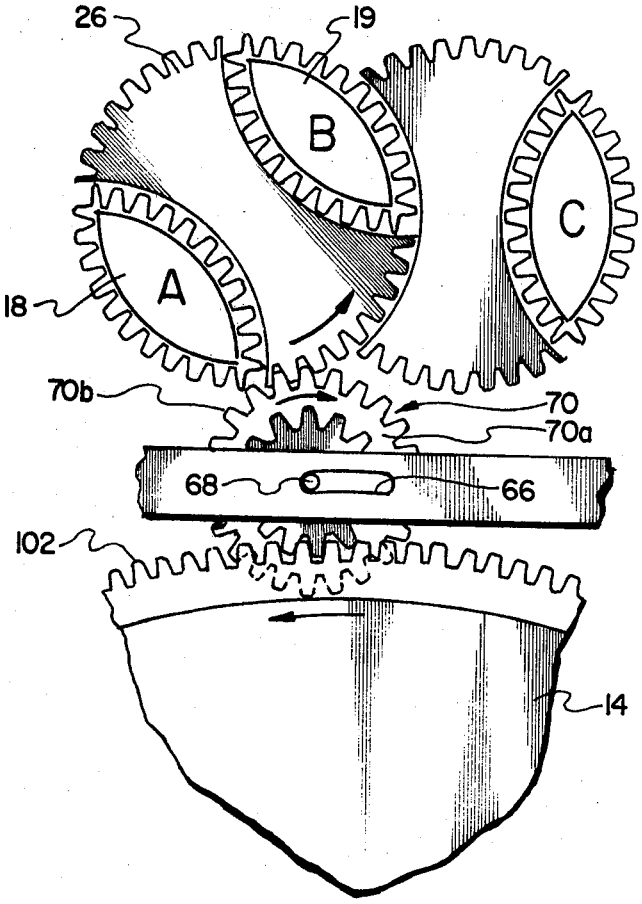
Figure 9:
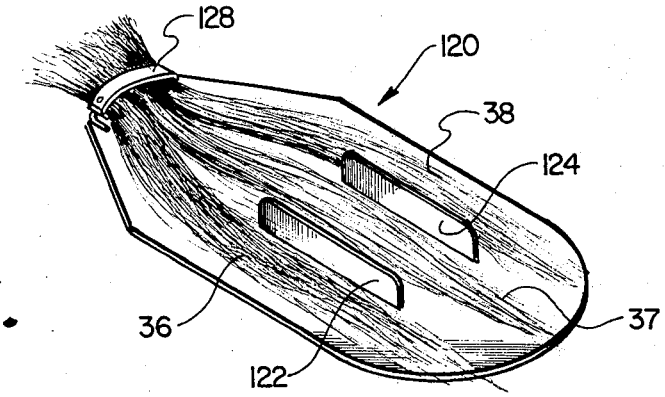
FIG. 9 is a perspective view of an accessory device for facilitating use of the braiding apparatus of FIG. 1.
Figure 10:
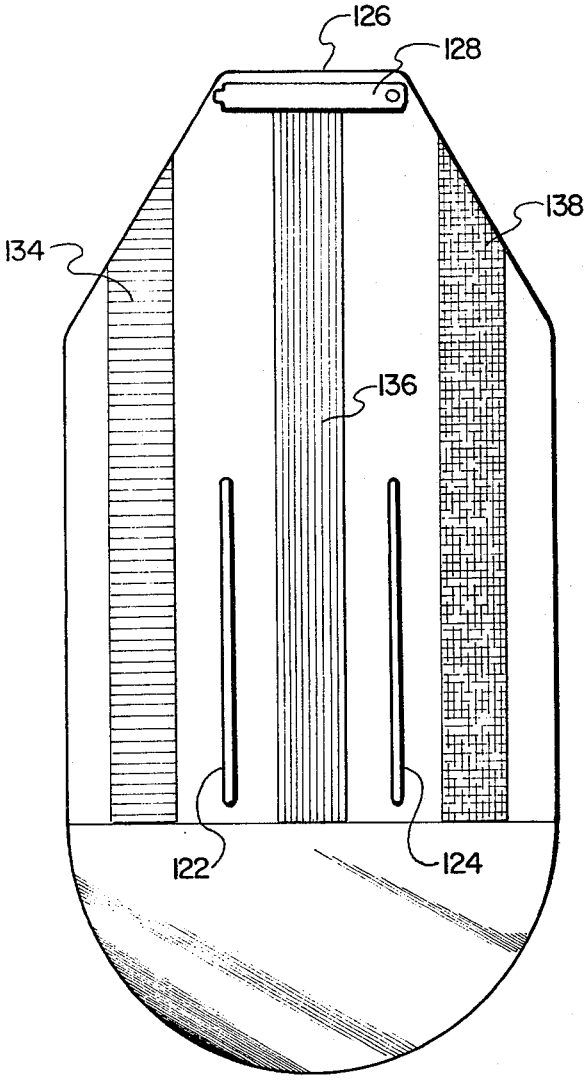
FIG. 10 is a plan view of the accessory device of FIG. 9.
Figure 11:
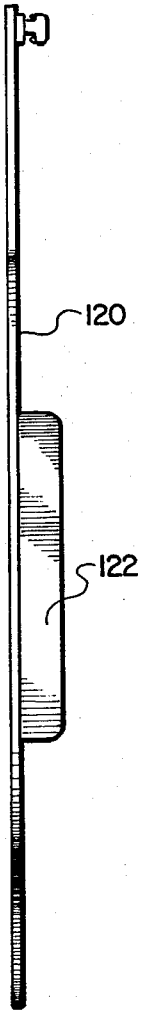
FIG. 11 is an end view of the device of FIG. 10.
Figure 12:
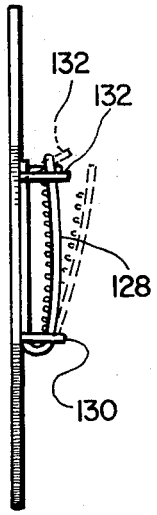
FIG. 12 is a top view of the device of FIG. 10.

Referring now to FIGS. 4 and 6–8, the operation of the operative components of the braiding device 10 will be described. In FIG. 4, the operative components are shown in their neutral position, that is, with the trigger member 14 in the position depicted in FIGS. 1 and 2. By reference to FIG. 6, as the trigger member is actuated or pivoted inwardly, the rack 102 is pivoted counter-clockwise as indicated by the arrow thereon, and with the rack 102 engaging the small diameter gear portion 70*a*, the pinion gear 70 has the axle 68 thereof moved to the left of slot 66 as depicted in FIG. 6 with the large diameter gear portion 70*b* thus engaging the outer gear teeth of the collective gear member formed by sector gear 26 and elliptical gear members 18 and 19, this collective gear being rotated counter-clockwise as indicated by the direction of the arrow thereon. The gear ratio of the composite gear cluster including rack 102, small diameter gear portion 70*a* and large diameter gear portion 70*b* of pinion gear 70 along with the diameter of the composite gear member (sector gear 26 and elliptical gear members 18 and 19) is selected to provide 180° of rotation of the composite gear member with one complete actuation of pivoting of the gear member 14 in the direction indicated by the arrow thereon. With this 180° rotation of the composite gear member, the elliptical gear members 18 and 19 exchange position, this being depicted in FIG. 7. During this movement, by reference to FIG. 2, the strands 36 and 37 will be interchanged to form a portion of the braid.

By reference again to FIG. 7, after movement of the trigger member 14 in the clockwise direction referred to in FIG. 6, as the trigger member 14 is released slightly, the elliptical gear members 18 and 19 will be interchanged as depicted in FIG. 7, while the pinion gear 70 moves to the right as depicted in FIG. 7 with the axle 68 thereof midway within axle slot 66. As the trigger member 14 is further released under force of the bias of the compression spring 92 to be returned to the position shown in FIGS. 1 and 2, by reference to FIG. 8, the pinion gear 70 will be moved to the right as viewed therein. In this position, the axle 68 of pinion gear 70 will be to the right of the slot 66 with the large diameter gear portion 70*b* of pinion gear 70 engaging the composite gear formed by the continuous periphery of the outer edges of elliptical gear members 20 and 18 and the gear teeth of the intervening sector gear 28.

Figure 8:
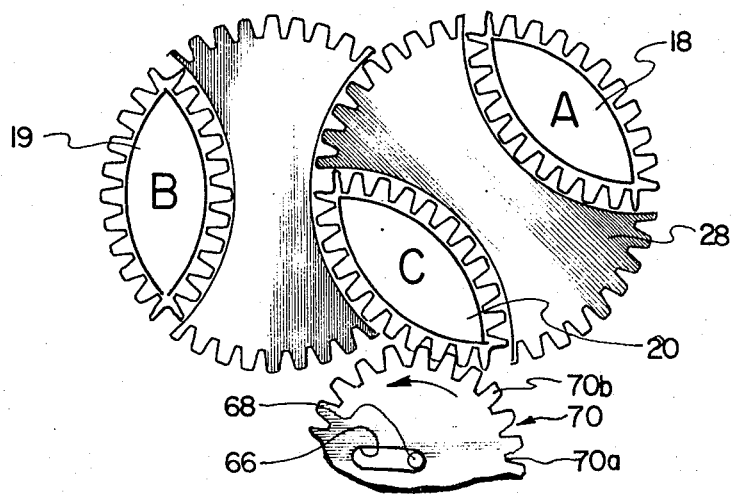
FIGS. 6 through 8 are diagrammatic views of the braiding gear components similar to FIG. 4 in various functional relationships.
Figure 7:
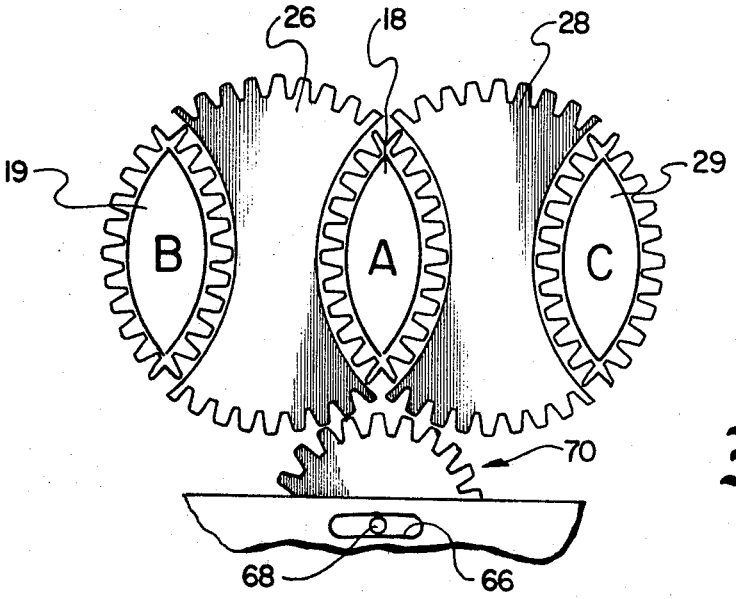

As shown in FIG. 8, as the trigger member 14 along with its rack 102 (not shown) moves to the right, the pinion gear 70 is rotated in the counter-clockwise direction, thus rotating the composite gear clockwise as indicated by the arrow on elliptical gear member 20, this action likewise rotating the composite gear through 180°. As shown in FIG. 8, the composite gear has rotated through approximately 135° and will continue to rotate until the elliptical gear member 20 is in the position previously occupied by elliptical gear 18 as viewed in FIG. 7. With this action, by reference again to FIG. 2, this repositioning will cause the strand 38 to be entwined about the strand 37 to complete one more loop of the braid. This action is then repeated by depression and release of the trigger member 14. As this action is repeated, by reference to FIG. 2, the braiding device 10 is moved downwardly with the tension tips 22–24 maintaining the strands 36–38 respectively in tension during this relative movement of the strands 36–38 therethrough. By reference to FIGS. 3 and 4, during the time that pinion gear 70 coacts with one of the composite gears, it is essential that the other sector gear be fixed in its position. For this purpose, the detent member 60 is formed of a resilient material so that one of the pawls thereof is free to move out of or into engagement with one of the diametrically opposed apertures 26*a* or 28*a* of the sector gear 26 or 28 of the composite gear thus rotated, while maintaining the opposite sector gear in position. For example, by reference to FIG. 4, if the sector gear 26 is the engaged gear, pawl 62 will be lifted from aperture 26*a* to ride a circumferential groove of the composite gear defined by groove 26*b*, and grooves 19*d* and 18*d* of elliptical gears 18 and 19 respectively. During this time pawl 63 detents itself within aperture 28*a* of sector gear 28 maintaining it in position. Conversely, during engagement of pinion gear 70 with the composite gear including sector gear 28, pawl 63 will ride the groove defined by groove 28*b* and grooves 19*d* and 20*d* of elliptical gear members 19 and 20, respectively, while pawl 62 maintains sector gear 26 in the position shown in FIG. 4.

Referring now to FIGS. 9 through 12, there is an accessory device generally designated 120, to facilitate use of the braiding device 10 heretofore described. The accessory device 120 is generally planar and has first and second upwardly extending tab projections 122 and 124 dividing the length thereof into three equal portions. At the upper end 126 of the device 120, the device 120 is narrowed down and has mounted thereon a hair fastening clip 128. Depicted in FIG. 12, the clip 128 is essentially a U-shaped member having the bottom edge thereof secured to the surface of the device 120. The closed end of the U-shaped clip 128 has a first inverted U-shaped member 130 secured thereover a short distance from the bight portion for providing spring tension of the hinge end of the clip 128. The other free end of the clip 128 is retained in position by a pivotable clasp 132 which may be pivoted to the dotted line position to permit the clip 128 to spring out to the dotted line position for permitting insertion of hair therethrough. Essentially clip 128 is configured as a barrette.

Referring to FIGS . 9 and 10, the three spaces on the device 120 formed by the parallel partitions 122 and 124 may be provided with color coded longitudinally extending strips 134,136 and 138 which correspond to color coded tension tips 22–24 respectively.

In use, the edge 126 of the device 120 is positioned against the scalp of the doll (or person) whose hair is to be braided. With the clip 128 in its open position, the hair is then placed on the upper surface of the device 120 and the clip 128 then closed. The hair is then divided into three generally equal strands 36–38 with the upwardly extending partitions 122 and 124 separating the thus divided strands. At this point, the user then takes the three feeder blades 40 and hooks one strand over the hook portion 42 of each of the blades 40. Each of the feeder blades 40 is then inserted through the appropriate aligned feeder tip 22–24 of the braiding device 10 until all three strands 36–38 extend therethrough the same distance. The feeder blades 40 are then removed, after which the clip device 128 of the accessory device 120 is removed to permit operation of the braiding device 10 as previously described. The accessory device of FIGS. 9–12 is intended to simplify operation for use by a child of tender years, and it is to be understood that rather than color-coding, numerals or other indicia may be utilized on the acessory device 120 to correspond to similarly placed indicia on the upper surface of housing 10 or on feeder tips 22–24.

In accordance with the present invention, there has been shown and described an uncomplicated braiding device which is hand operated and may be used with human hair or with the simulated hair of a doll for providing braids or plaits. Furthermore, with the accessory device 120, the device may be readily utilized by a child of tender years. The mechanism of the braiding device includes few active components with few parts which are readily fabricated from a material such as plastic with the overall device being readily assembled. While there has been shown and described a preferred embodiment, it is to be understood that various other adaptations and modifications may be made within the spirit and scope of the invention.

I claim:

1. In hair braiding apparatus, the combination comprising:

housing means configured for being hand held;

lever means pivotally supported within said housing, said lever means being configured for hand operation;

rack means operable in conjunction with said lever means;

first, second and third gear means in aligned relation, each of said gear means being movably supported within said housing means and having aperture means for passage therethrough of a strand of hair to be braided; and means operable by said rack means and coacting with said first, second and third gear means for interchanging the positions of a first two adjacent ones of said gear means in response to pivoting of said lever means in one direction, and for interchanging the positions of the third of said gear means with the adjacently positioned gear means in response to pivoting of said lever means in the opposite direction, whereby repeated pivoting of said lever means cause the braiding of the strands of hair.

2. The combination according to claim 1 wherein said apparatus further includes means coupled to each of said first, second and third gear means for maintaining the strands of hair passing therethrough in tension.

3. The combination according to claim 1 wherein said first, second and third gear means are generally identically configured elliptically shaped gear members, and said apparatus further includes first and second generally identical sector gear members interposed between adjacent ones of said elliptically shaped gear members.

4. The combination according to claim 3 wherein each sector gear member is configured for generally mating abutting engagement with a pair of said elliptically shaped gear members for defining a composite gear member.

5. The combination according to claim 4 wherein said means operable by said rack means includes pinion means rotatable within an elongate slot for being urged into meshing engagement with a first composite gear member in response to movement of said rack means by pivoting of said lever means in one direction, and for being urged into meshing engagement with a second composite gear member by said rack means in response to pivoting of said lever means in the other direction.

6. In hair braiding apparatus, the combination comprising:

housing means configured for being hand held;

lever means pivotally supported within said housing, said lever means being configured for hand operation;

arcuately configured rack means on said lever means;

bias means coacting with said lever means for urging said lever means in a first direction;

first, second and third generally identically configured elliptical gear members positioned in aligned relation, each of said elliptical gear members being movably supported within said housing means and having aperture means for passage therethrough of strands of hair to be braided;

first and second generally identically configured sector gear members positioned between adjacent ones of said elliptical gear members, one of said sector gear members and the adjacent ones of said elliptical gear members being configured for providing a rotatable composite gear member;

a pinion gear member having the axle thereof mounted within a pair opposing elongate slots within said housing means, said pinion gear member being in constant meshing engagement with said rack means and movable into meshing engagement with a first composite gear member for interchanging the positions of a first two adjacent ones of said elliptical gear members in response to pivoting of said lever means in one direction, and movable into meshing engagement with a second composite gear member for interchanging the positions of the third of said elliptical gear members with the adjacently positioned elliptical gear member in response to pivoting of said lever means in the opposite direction, whereby repeated pivoting of said lever means causes braiding of the strands of hair.

7. The combination according to claim 6 wherein said apparatus further includes means on said first, second and third elliptical gear members for providing tension to the strand of hair passed therethrough.

8. The combination according to claim 7 wherein said means for providing tension includes tensioning members formed of a resilient material having apertures extending therethrough in alignment with the aperture means of said elliptical gear members.

9. The combination according to claim 8 wherein said apparatus further includes a generally elongate tubular member on each of said first, second and third elliptical gear members on the side thereof opposite said tensioning member.

10. The combination according to claim 9 further including detent means coacting with each of said sector gear members for maintaining the position of one of said sector gear members during rotation of the composite gear member including the other sector gear member.

11. The combination according to claim 10 wherein said apparatus further includes spring bias means within said housing means urging against said lever means.

* * * * *